United States Patent [19]

Deutsch

[11] Patent Number: 4,671,243

[45] Date of Patent: Jun. 9, 1987

[54] OXYGEN SENSOR FAULT DETECTION AND RESPONSE SYSTEM

[75] Inventor: Robert W. Deutsch, Sugar Grove, Ill.

[73] Assignee: Motorola, Inc., Schaumburg, Ill.

[21] Appl. No.: 834,986

[22] Filed: Feb. 28, 1986

[51] Int. Cl.[4] ..... F02M 51/00

[52] U.S. Cl. ..... 123/489; 123/440

[58] Field of Search ..... 123/489, 440

[56] References Cited

U.S. PATENT DOCUMENTS

| | | | |
|---|---|---|---|
| 3,903,853 | 9/1975 | Kizler | 123/32 |
| 3,916,848 | 11/1975 | Schmidt | 123/32 |
| 4,096,834 | 6/1978 | Norimatsu et al. | 123/32 |
| 4,111,171 | 9/1978 | Aono et al. | 123/489 |
| 4,170,967 | 10/1979 | Wessel et al. | 123/489 |
| 4,170,969 | 10/1979 | Asano | 123/489 |
| 4,213,180 | 7/1980 | Marchak et al. | 364/431 |
| 4,252,098 | 2/1981 | Jounczak et al. | 123/489 |
| 4,364,356 | 12/1982 | Gerbold | 123/489 |
| 4,479,464 | 10/1984 | Kondo et al. | 123/489 |
| 4,497,296 | 2/1985 | Nakajima et al. | 123/440 |
| 4,502,443 | 3/1985 | Hasegawa et al. | 123/440 |
| 4,505,246 | 3/1985 | Nakajima et al. | 123/440 |
| 4,522,180 | 6/1985 | Matsuoka et al. | 123/489 |
| 4,528,962 | 7/1985 | Auth | 123/489 |
| 4,556,033 | 12/1985 | Ao et al. | 123/440 |

*Primary Examiner*—Raymond A. Nelli

*Attorney, Agent, or Firm*—Steven G. Parmelee; Robert J. Crawford

[57] ABSTRACT

A fault detection and response system having particular applicability for use with oxygen sensors and closed loop control systems. The system includes a confidence measuring unit as part of a fault control unit (26) that maintains a measure of confidence with respect to the recent operating history of the oxygen sensor. This measure of confidence is increased upon detecting state changes of the oxygen sense signal through use of a state change detector (24), and decreased upon detecting that an integrated form of the oxygen sense signal has attained a predetermined limit as sensed by a limit detector (22). Based upon this measure of confidence, the system can respond to perceived fault conditions in various ways. In general, with a high measure of confidence being present, the system will favor closed loop control even in the presence of a perceived oxygen sensor fault. Similarly, with a low measure of confidence, the system will favor open loop control. During such open loop control, however, occasional attempts at closed loop control will still be made, as the system ultimately favors closed loop control over open loop control.

26 Claims, 5 Drawing Figures

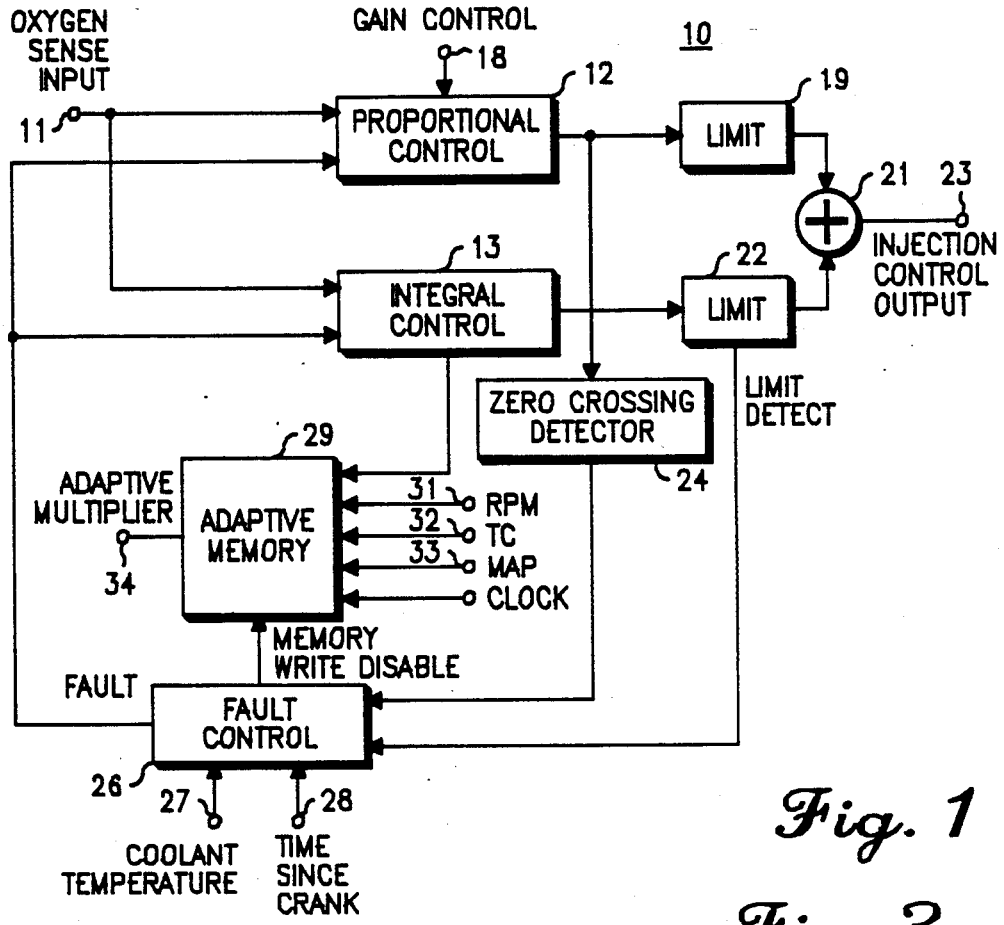
Fig. 1
Fig. 2
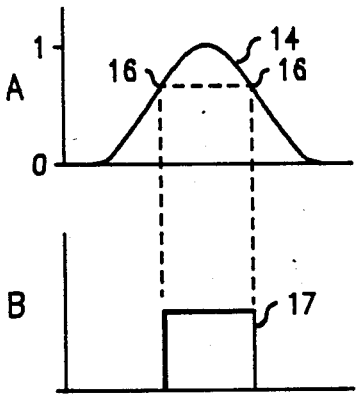
Fig. 3
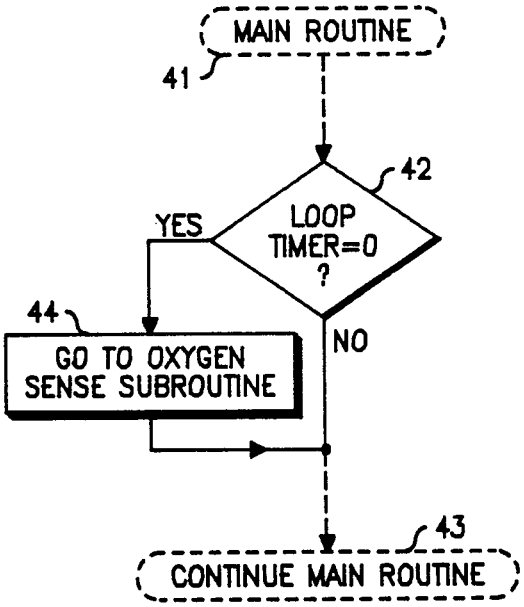

OXYGEN SENSOR FAULT DETECTION AND RESPONSE SYSTEM

TECHNICAL FIELD

This invention relates generally to systems that utilize oxygen sensors, and more particularly to closed loop control of fuel delivery systems as based at least in part on oxygen sensor input.

BACKGROUND ART

Spark ignition internal combustion engines are well known in the art. Such engines operate by exposing an air/fuel mixture to a spark. The resulting explosion creates force that the engine translates into mechanical work. The efficiency of the combustion process depends, at least in part, on the ratio of air to fuel. This parameter can be calculated and utilized in a closed loop system to control the combustion process through appropriate use of a strategically located oxygen sensor, all as well understood in the art.

So long as the oxygen sensor provides accurate data, a closed loop control system as described above can effectively and efficiently control fuel delivery to an internal combustion engine. Open loop control, of course, could also be effectuated by making assumptions regarding the missing parameter. Unfortunately, such assumptions are typically inaccurate, and continuous open loop control of a fuel delivery system yields far less efficiency than a closed loop system that utilizes input from an appropriately located oxygen sensor.

Oxygen sensors are typically formed of zirconium oxide material. These sensors typically provide an output signal that fluctuates between zero and one volt depending upon the oxygen concentration sensed. Unfortunately, these sensors are somewhat temperature dependent and their performance characteristics can also change over time. Further, continuous reliable receipt of oxygen sensor signals cannot always be assured for a variety of reasons. Therefore, oxygen sensors typically provide nonuseful data during the initial cranking phases of engine operation, and also may experience transient dropouts from time to time during normal operation.

One prior art response has been to continuously maintain closed loop control regardless of the validity of the incoming oxygen sensor data. When the oxygen sensor faults for long periods of time, however, this can have highly detrimental impact on engine efficiency and operation. Another prior art approach has been to switch to open loop control upon sensing that the oxygen sensor has faulted. Since such sensors are subject to frequent periods of nonuseful operation, this can result in long periods of open loop control that do not provide optimum operation of the engine in question.

There therefore exists a need for an oxygen sensor fault detection and response system that allows a fuel delivery system to detect and appropriately respond to a faulty oxygen sensor input, without unduly compromising or restricting ability of the system to accommodate the transient operating capabilities of oxygen sensors in general.

SUMMARY OF THE INVENTION

The invention described in this specification meets the above noted needs through provision of an oxygen sensor fault detection and response system. The invention operates in conjunction with a control system having an oxygen sensing unit, a fault detection unit, and a control unit.

The oxygen sensing unit senses oxygen in a monitored area and provides an oxygen sense signal in response to this monitoring. The fault detection unit responds to indicia that the oxygen sensing unit has faulted, and provides a fault signal in response to detecting such indicia. The control unit receives the oxygen sense signal and the fault signal, and based at least in part upon these inputs, selectively provides either closed loop control or open loop control of an output control signal.

When providing closed loop control, the output control signal becomes a function, at least in part, of the oxygen sense signal in accordance with well understood feedback technique. When providing open loop control, the control unit substantially ignores any oxygen sense signal that may be received and controls the output control signal essentially independently of the oxygen sensing unit. (It should be understood that the open loop control provided by the control unit may be closed loop from the standpoint of other parameters; the applicant uses the terminology "open loop control" and "closed loop control" with respect to the oxygen sense signal only.)

An example of such a control system can be found in an automobile. The fuel delivery systems for many spark ignition internal combustion engines typically utilize an oxygen sensor to allow the air/fuel ratio to be monitored and subsequently controlled through manipulation of fuel delivery.

The invention operates in the above noted environment and functions generally to provide closed loop control when receiving a viable oxygen sense signal and to provide open loop control when the fault signal indicates a fault with respect to receipt of the oxygen sense signal. In one embodiment, a first delay unit causes the control unit to delay switching from closed loop control to open loop control when receiving a fault signal. In another embodiment, the duration of this delay can be made a function of current confidence in the oxygen sensing unit. To accomplish this, a confidence measuring unit can measure confidence in the oxygen sensing unit as based on historic operability data. In particular, the measure of confidence can be increased for each occurrence of an event that indicates operability of the oxygen sensing unit, and decreased for each occurrence of an event that indicates nonoperability of the oxygen sensing unit.

When so configured, the delay provided by the first delay unit can be made longer when the measure of confidence indicates a high degree of confidence in the operability of the oxygen sensor unit, and a shorter or nonexistent delay can be provided for lessor degrees of confidence. Pursuant to this, if the oxygen sensor unit has been providing a viable signal for a significant period of time, the invention will not disrupt closed loop control in favor of open loop control merely upon detecting an interruption of the oxygen sense signal, since the interruption may well be short lived, or a short lived transient condition that is unrelated to oxygen sensor integrity. On the other hand, if the measure of confidence appears low, the invention will delay less time in instituting open loop control rather than awaiting a signal that, by recent historical appearances, may be some time in appearing.

In another embodiment of the invention, a closed loop reinitiation unit may be provided for periodically causing the control unit to interrupt open loop control and to again attempt closed loop control. If the attempt at closed loop control fails, open loop control becomes reestablished. If, however, closed loop control succeeds, the closed loop control will be maintained. In yet another embodiment, the closed loop reinitiation unit can be made sensitive to the measure of confidence provided by the confidence measuring unit described above. So configured, the periodicity of interrupting open loop control to attempt closed loop control can be made to depend, at least in part, on the measure of confidence. If the measure of confidence reflects a low degree of confidence, the duration of time provided between attempts at closed loop control can be made relatively long, whereas a measure of confidence that indicates a higher degree of confidence in the operability of the oxygen sensing unit provides grounds for allowing minimal delays between closed loop attempts.

In yet another embodiment, a second delay unit can be provided for preventing the control unit from provding closed loop control until at least two system parameters (such as coolant temperature and engine operating time) have been satisfied. Finally, in yet another embodiment, a memory write disable unit can be provided to respond to the presence of a fault signal by preventing the control unit from writing to an associated memory device, such as an EEPROM or standby RAM.

Through provision of the above briefly summarized invention, the benefits of closed loop control based on an oxygen sense input can be realized while simultaneously accommodating the vaguaries currently associated with use of such a device. An oxygen sense input having a recent history reflecting viable operability will be allowed greater leeway and provoke responses favoring closed loop control. An oxygen sense input having a recent history reflecting sporadic or nonviable operation will provoke a response favoring open loop control, yet without abandoning attempts to regain closed loop control on a periodic basis.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein:

FIG. 1 comprises a block diagram depiction of the invention;

FIG. 2 comprises waveform diagrams depicting an oxygen sensor signal;

FIG. 3 comprises a flowchart of an oxygen sense subroutine in relation to a mainfuel delivery system routine;

BEST MODE FOR CARRYING OUT THE INVENTION

Figure 4:
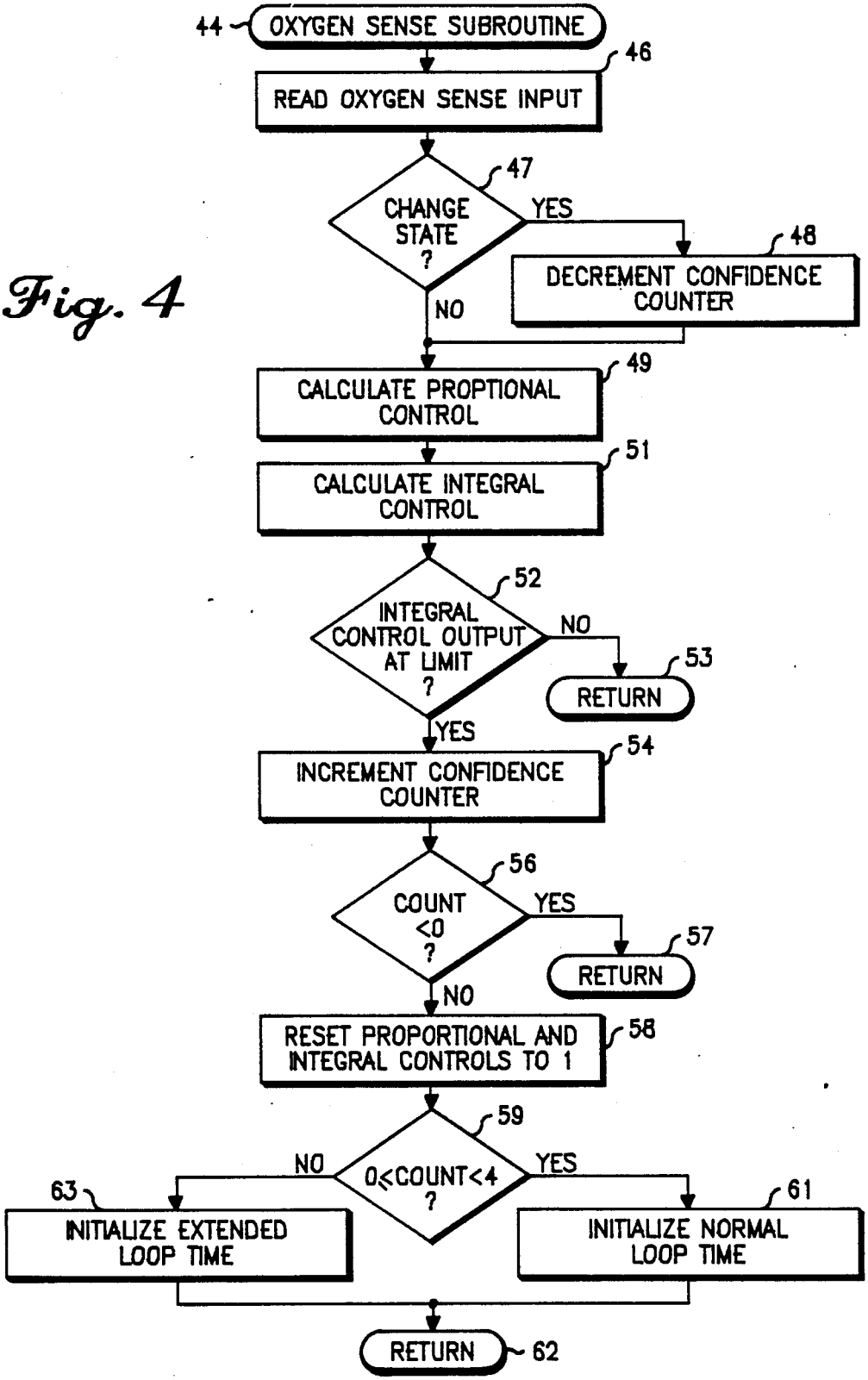
FIG. 4 comprises a flowchart of the oxygen sense subroutine.

Referring now to the drawings, and in particular to FIG. 1, the invention as configured in conjunction with a fuel delivery system in an automobile can be seen as depicted generally by the numeral 10. Although the invention will be described from the standpoint of an automotive environment, it should be understood that many of the concepts and teachings inherent to the invention are not limited to an automotive environment.

The fuel delivery system includes an oxygen sense input (11) for receiving an oxygen sense signal. The oxygen sense signal can be initially generated through use of a zirconium oxide sensor (not shown) as well known in the art. With reference to FIG. 2A, such sensors typically provide an output signal (14) having a range of zero to one volt, depending upon the oxygen concentration in the vicinity of the sensor. Generally, this raw sensor output (14) will be provided to a differential comparator (not shown) that respond to a predetermined threshold (16) and that provides a logic level output of zero or one (FIG. 2B)(17). The resultant output (17) constitutes the oxygen sense signal received at the oxygen sense input (11) of the fuel delivery system.

Referring again to FIG. 1, a proportional control (12) receives the oxygen sense signal and provides at its output a proportional signal with respect to the oxygen sense signal. A gain control input (18) controls the proportional factor in accordance with well understood prior art technique. The resultant proportional signal then passes through a limiter (19) to a summing junction (21). The output of the proprotional control (12) also connects to a zero crossing detector (24). The zero crossing detector (24) effectively detects a change of state in the proprotional control output and provides a signal in response thereto to a fault control unit (26).

An integral control (13) also receives the oxygen sense signal and provides an output signal that represents the integral of the oxygen sense signal. This integrated signal also passes through a limiter (22) to the summing junction (21). The output of the summing junction (21) constitutes an injection control output (23) that can provide, for instance, a pulse width modulated fuel delivery signal. The limiter (23) for the integrated signal also provides an output signal to the fault control unit (26) whenever a predetermined limit has been attained.

The fault control unit (26) also receives a coolant temperature input (27) and another input (28), such as time since cranking, for purposes that will be made more clear below. The fault control unit (26) has two primary outputs. The first output comprises a fault signal that supplies a logic one signal to the inputs of both the proportional control (12) and the integral control (13) for purposes that will be made more clear below. The second output provides a memory write disable signal to an adaptive memory (29).

Such adaptive memories (29) are well known in automotive applications. In particular, such memories can store information regarding RPM (31), tachometer (32), mass air pressure (33) and the like as regards the fuel delivery system. By monitoring and recording such individual parameters for an individual system in an adaptive memory (29), the fuel delivery system can be fine tuned automatically to the operating characteristics of a given engine. The adaptive multiplier output (34) can then be suitably utilized as well known in the art.

The memory write disable signal from the fault control unit (26) disables the adaptive memory (29) from having any subsequent data written to its memory. By this provision, the invention will prevent faulty data from being written to the adaptive memory (29) during times when operability of the oxygen sensor unit appears suspect.

When operating normally, the fuel delivery system will process an oxygen sense signal through both the proportional control (12) and the integral control (13). These processed signals are then limited and combined at a summation junction (21). The resulting signal can be utilized to control fuel delivery. This in turn will affect the oxygen content in the monitored area, and this change will be sensed at the oxygen sense input (11), thereby providing feedback and defining the closed loop operating mode of the fuel delivery system.

The zero crossing detector (24) of the invention can detect viability of the oxygen sense signal. State changes at the oxygen sense input constitute an indicia of operability, and such state changes can be detected by the zero crossing detector (24). The limit detect output from the limiter (22) associated with the integrated signal path can be monitored to detect an oxygen sense fault. The achievement by the integrated signal of a predetermined limit constitutes an indicia of nonoperability, which in turn can be acted upon by the fault control unit (26) as described below.

Referring now to FIG. 3, an appropriate microprocessor (not shown), such as a 6801U4 as manufactured by Motorola, Inc., provides one means of providing a physical embodiment for the above described system. In fact, such implementations of a fuel delivery system are known in the art, and no further description of such a fuel delivery system need be set forth here. It will be noted, however, with respect to FIG. 3, that the main routine (41) for a program in such a fuel delivery system can have a decision making block (42) to determine whether a preestablished loop timer now equals zero. If not, the main routine may be continued (43). If, however, the loop timer equals zero, then an oxygen sense subroutine (44) pertinent to this invention may be processed.

Prior to discussing the operation of the oxygen sense subroutine (44) in more detail, it may be helpful to the reader to first review the essentials of a numbers manipulation system kwown as two's complement arithmetic. Two's complement arithmetic techniques are useful in the context of eight bit processors such as the 6801U4 referred to above, and this technique finds applicability in the present invention as well.

In two's complement arithmetic, an eight bit string of binary numbers can comprise a single encoded data entry. The most significant bit indicates whether the representative number is greater than or less than zero. More particularly, a zero for the most significant bit indicates a positive number and a one for the most significant bit indicates a negative number. As regards the remaining bits, the binary entries from zero to 127 equate exactly with the represented numbers zero to 127. When the most significant bit equals a one, however, the represented number is negative and must be calculated by subtracting from its a preestablished constant. For instance, the binary number 128 represents negative 128, and the binary number 255 represents negative one. The applicability of two's complement arithmetic will be made apparent below where appropriate.

With reference to FIG. 4, the oxygen sense subroutine (44) will now be described.

The subroutine (44) begins by reading the oxygen sense input (46). Following this, a decision can be made as to whether the oxygen sense signal has changed state (47). Such a determination can be made with respect to either the raw input signal itself, or with reference to the output of the proportional control (12) as provided in the above described embodiment. If the oxygen sense signal has changed state, this constitutes an indicia of operability. That is, the oxygen sense signal will not oridinarily undergo state changes when in a fault mode. Therefore, if such an indicia of operability has been sensed, a confidence count will be decremented (48) to indicate an irease in the measure of confidence.

This confidence count comprises a means of measuring confidence in the oxygen sensor input as based upon recent operability history. The count itself resides as an eight bit number configured in two's complement arithmetic. Decrementing this count will yield a more negative number. Such decrementing can occur down to a predetermined limit, in this case the limit being determined by the maximum negative two's complement arithmetic number that can be stored in the eight bit count itself; i.e., negative 128. In general, the more negative the number, the higher the measure of confidence.

Following this decrementing stage, or presuming that no state change can be perceived, the subroutine (44) will then provide closed loop control by calculating the proportional control value (49) and the integral control value (51) described above with respect to FIG. 1. Following this, a decision will be made as to whether the integral control output at least equals a predetermined limit (52). If this limit has not been equalled, the subroutine (44) will return the processor to the main routine (53). If, however, the integral control output does equal the predetermined limit, the confidence counter referred to above will be incremented (54) to degrade the measure of confidence in the oxygen sense signal. The eight bit binary count referred to above can be incremented to 127 as a maximum positive number.

Following this incremental increase in the confidence count, a decision will be made as to whether the count is less than zero (56). If so, the subroutine (44) will interpret this as a show of confidence, and the subroutine (44) will return processing control back to the main routine (57).

If the count equals or exceeds zero, however, the subroutine (44) will reset the proportional and integral controls to one (58) to serve as an open loop control parameter. Following this, a determination will be made as to whether the count is greater than or equal to zero yet less than four (59). If true, the subroutine (44) will interpret this as a moderate show of confidence, and a normal loop time will be initialized (61). Processing control will then be returned to the main routine (62). If the count exceeds four, the subroutine (44) will interpret this as a low measure of confidence is low and an extended loop time will be initialized (63) prior to returning to the main routine (62).

During normal loop time operation, the oxygen sense subroutine (44) will ordinarily be quickly reinitiated by the main routine (41) (FIG. 2), thereby providing for frequency closed loop recalculation of the proportional and integral control signals (49 and 51). Extended loop time, however, will delay the length of time that passes before the oxygen sense subroutine (44) will again be processed, thereby extending the duration of open loop control before again attempting closed loop control.

Figure 5:
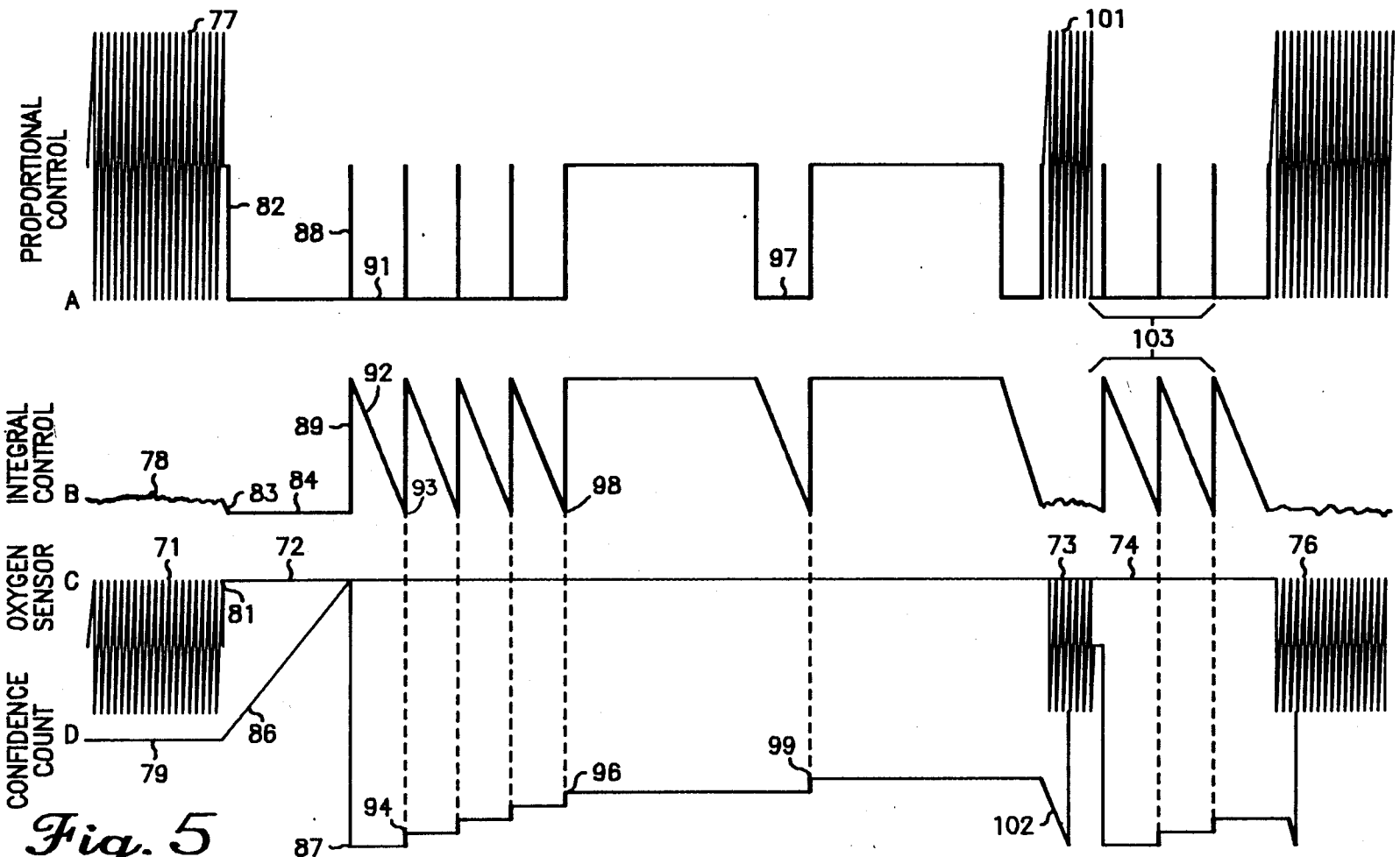
FIG. 5 comprises waveform diagrams depicting operation of the invention.

The effect of these control decisions will be made more clear upon making reference to FIG. 5.

FIG. 5C depicts a representative oxygen sensor signal input. It can be seen that normal closed loop control results in a plurality of oxygen sense signal state changes (71). These state changes cease when the oxygen sense signal fails (72). In this example, the signal again becomes active for a brief period of time (73), followed by another failure. Finally, the signal renews normal operation (76).

With reference to FIGS. 5A and 5B, it can be seen that during the initial normal operation of the oxygen sensor input (71), the proportional control provides a proportionately larger signal (77) that passes through an identical number of state changes, and that the integral control signal provides an integrated signal (78) that comprises the integrated form of the oxygen sensor signal (71).

With respect to FIG. 5D, the confidence count can be seen to be stable at a count (79) that equals the binary equivalent of 128, which constitutes the two's complement arithmetic equivalent of the most negative number. For purposes of this illustration, it will be presumed that the oxygen sense input has been operating correctly for some period of time, and that the confidence count has been maintained at this most negative number for a period of time, thereby providing the highest measure of confidence in the oxygen sensor input.

When the oxygen sensor signal input first fails (81) (FIG. 5C), the proportional control output signal drops to zero shortly thereafter (82) (FIG. 5A), as does the integral control signal (83) (FIG. 5B). When this occurs, no subsequent state changes occur with respect to the proportional control signal that would serve to decrement the confidence count to thereby increase the measure of confidence. At the same time, the integral control signal resides at its predetermined limite (84), which, upon each processing of the oxygen sense subroutine (44), will cause an increment of the confidence count (86).

Since at this time the confidence count remains less than zero (in twos complement arithmetic), no open loop control will be provided. Instead, given the high measure of confidence, the invention will continue closed loop control regardless of the nonoperable status of the oxygen sensor signal (72) (FIG. 5C).

When at last the confidence count reaches zero (87) (FIG. 5D), the proportional and integral controls will be reset to one (88 and 89) (FIGS. 5A and B), respectively) as described above with respect to the subroutine (44). Since normal loop time has been chosen (because the confidence count is equal to or greater than zero but less than 4), the subroutine (44) will quickly be reprocessed, resulting in an attempt at closed loop control. In this example, this attempt will result in a return of the proportional control signal to zero (91) (FIG. 5A) and an integrated return of the integral control output (92) (FIG. 5B) to the lower limit (93). When the lower limit has been attained by the integral control signal, the confidence count will be incremented by one (94) (FIG. 5D) (to diminish the measure of confidence).

This process of attempting closed loop control and then initiating open loop control in rapid succession will continue until the confidence count equals 4 (96) (FIG. 5D). When this occurs, the subroutine (44) will initialize an extended loop time as described above to allow open loop control of the fuel delivery system to prevail for a longer period of time. This open loop control will continue until the loop timer expires and the processor again processes the oxygen sense subroutine (44). When this occurs in the illustration shown, the oxygen sensor input has not yet recovered (72) (FIG. 5C), and therefore the return to closed loop control will cause the proprotional control signal to drop to zero (97) (FIG. 5A) and the integral control signal to become integrated to its lower limit (98) (FIG. 5B). This attainment of the lower limit (98) will cause an incrementing of the confidence count (99) (FIG. 5D), thereby decreasing the measure of confidence. The process will then repeat with another extended loop time.

In the illustration shown, the oxygen sensor signal briefly recovers (73) (FIG. 5C), thereby providing a plurality of state changes (101) (FIG. 5A) in the proportional control signal that cuase the confidence count to be decremented (102) (FIG. 5D). Therefore, when the oxygen sense signal again faults (74) (FIG. 5C), a small measure of confidence will be provided. As a result, rapid repeated attempts at closed loop control will again follow (103) (FIGS. 6A and B) until the confidence count again equals 4, or until the oxygen sensor signal recovers (76) (FIG. 5C) as depicted.

In essence, the, operation of the invention may be summarized as follows. The invention maintains a measure of confidence as regards the recent operability history of an oxygen sensor. This measure of confidence is increased upon detecting the occurrence of an event that constitutes an indicia of operability of the oxygen sensor, and is decreased upon detecting the occurrence of an event that constitutes an indicia of nonoperability. Based upon this measure of confidence, the invention will fluctuate in a controlled fashion between open loop and closed loop control in a manner calculated to realize the primary benefits of an oxygen sensor signal while minimizing operating deficiencies that can occur upon experiencing oxygen sensor signal dropouts.

Those skilled in the art will recognize that many variations and modifications could be practiced with respect to the invention, and hence it should be understood that the attached claims are not to be considered as being limited to the precise embodiment depicted in the absence of express limitations in the claims directed to such embodiments.

I claim:

1. In a control system having:

oxygen sensing means for sensing oxygen in a monitored area and for providing an oxygen sense signal in response thereto;

an improvement comprising fault detection means for responding to indicia that said oxygen sensing means has faulted, and for providing a fault signal indicative of past operability thereof;

control means for receiving said oxygen sense signal and said fault signal, and for selectively providing loop control functions including:

closed loop control of an output control signal, based at least inpart on said oxygen sense signal, and open loop control of said output control signal upon receiving said fault signal, wherein said open loop control substantially ignores said oxygen sense signal; and variable delay means for causing said control means to delay switching from one of said loop control functions to the other of said loop control functions, wherein the delay is set, at least in part, according to the past operability of said oxygen sensing means indicated by said fault signal.

2. The improvement of claim 1 and further including closed loop reinitiation means for periodically causing said control means, while providing open loop control of said output control signal, to attempt said closed loop control of said output control signal, and upon attempting said closed loop control and in the absence of said fault signal, for subsequently causing said closed loop control to be maintained.

3. The improvement of claim 1 wherein said delay has an upper maximum preselected duration.

4. The improvement of claim 1 wherein the fault detection means further includes means for providing a measure of confidence base on the past operability of said oxygen sensing means.

5. The improvement of claim 4 wherein said measure of confidence is increased for each occurrence of an event that indicates operability of said oxygen sensing means, and wherein said measure of confidence is decreased for each occurrence of an event that indicates non-operability of said oxygen sensing means.

6. The improvement of claim 5 wherein said event that indicates operability of said oxygen sensing means is a change of state of said oxygen sense signal as received by said control means.

7. The improvement of claim 6 wherein said control means further includes integration means for integrating said oxygen sense signal, and wherein said event that indicates non-operability of said oxygen sensing means is attainment of said integrated oxygen sense signal of a predetermined limit.

8. The improvement of claim 5 wherein said measure of confidence comprises a count, wherein:

said count is decremented for each occurrence of said event that indicates operability of said oxygen sensing means;

and said count is incremented for each occurrence of said event that indicates non-operability of said oxygen sensing means.

9. The improvement of claim 8 wherein said count can decrement to only a predetermined lower limit, and can increment to only a predetermined higher limit.

10. The improvement of claim 9 wherein said delay provided by said delay means has an upper maximum preselected duration, said upper maixmum duration resulting when said count equals said predetermined lower limit.

11. The improvement of claim 1 wherein said control system further includes an adaptive memory for storing operational details relating to a particular operating environment with which the control system operates, and wherein said adaptive memory responds to said fault signal by prohibiting writing to its memory so long as said fault signal persists.

12. In a control system having:

oxygen sensing means for sensing oxygen in a monitored area and for providing an oxygen sense signal in response thereto;

fault detection means for responding to indicia that said oxygen sensing means has faulted, and for providing a fault signal in response thereto; and control means for receiving said oxygen sense signal and said fault signal, and for selectively providing:

closed loop control of an output control signal, based at least in part on said oxygen sense signal; and open loop control of said output control signal upon receiving said fault signal, wherein said open loop control substantially ignores said oxygen sense signal;

an improvement comprising closed loop reinitiation means for periodically causing said control means, from open loop control of said output control signal, in response to said fault signal to attempt said closed loop control of said output control signal, and upon attempting said closed loop control and inthe absence of said fault signal, for subsequently causing said closed loop control to be maintained.

13. The improvement of claim 12 and further including measuring means for determining operability in said oxygen sensing means based on previous operability thereof and for providing a measure of confidence based thereon, wherein said periodicity of attempting said closed loop control depends, at least in part, upon said measure of confidence.

14. The improvement of claim 13 wherein said measure of confidence is increased for each occurrence of an event that indicates operability of said oxygen sensing means, and wherein said measure of confidence is decreased for each occurrence of an event that indicates non-operability of said oxygen sensing means.

15. The improvement of claim 14 wherein said closed loop reinitiation means can selectively periodically attempt said closed loop control at a first rate and at a second rate, with said first rate being faster than said second rate.

16. The improvement of claim 15 wherein said first rate of periodicity for repeated attempts at closed loop control will result despite repeated occurrences of said event that indicates non-operability, unless and until said measure of confidence diminishes below a predetermined limit.

17. In a control system having:

oxygen sensing means for sensing oxygen in a monitored area and for providing an oxygen sense signal in response thereto;

fault detection means for responding to indicia that said oxygen sensing means has faulted, and for providing a fault signal in response thereto; and control means for receiving said oxygen sense signal and said fault signal, and for selectively providing:

closed loop control of an output control signal, based at least in part on said oxygen sense signal; and open loop control of said output control signal upon receiving said fault signal, whereins aid open loop control substantially ignores said oxygen sense signal;

an improvement comprising:

measuring mean sfor determining operability in said oxygen sensing means based on previous operability thereof and for providing a measure of confidence based thereon;

delay means for causing said control means to delay switching from said closed loop control to said open loop control upon receiving said fault signal, said delay having a duration that depends, at least in part, upon said measure of confidence; and closed loop reinitiation means for periodically causing said control means, while providing open loop control of said output control signal, to attempt said closed loop control of said output control signal,a nd upon attempting said closed loop control and the in the absence of said fault signal, for subsequently causing said closed loop control to be maintained, wherein said periodicity of attempting said closed loop control depends, at least in part, upon said measure of confidence.

18. The improvement of claim 17 wherein said measure of confidence is increased for each occurrence of an event that indicates operability of said oxygen sensing means, and wherein said measure of confidence is decreased for each occurrence of an event that indicates non-operability of said oxygen sensing means.

19. The improvement of claim 18 wherein wherein said measure of confidence comprises a count, wherein:

said count is decremented for each occurrence of said event that indicates operability of said oxygen sensing means;

and said count is incremented for each occurrence of said event that indicates non-operability of said oxygen sensing means.

20. The improvement of claim 19 wherein said count can decrement to only a predetermined lower limit, and can increment to only a predetermined higher limit.

21. The improvement of claim 20 wherein said delay provided by said delay means has an upper maximum preselected duration, said upper maximum duration resulting when said count equals said predetermined lower limit.

22. The improvement of claim 18 wherein said event that indicates operability of said oxygen sensing means is a change of state of said oxygen sense signal as received by said control means.

23. The improvement of claim 22 wherein said control means further includes integration means for integrating said oxygen sense signal, and wherein said event that indicates non-operability of said oxygen sensing means is attainment of said integrated oxygen sense signal of a predetermined limit.

24. The improvement of claim 23 wherein said closed loop reinitiation means can selectively periodically attempt said closed loop control at a first rate and at a second rate, with said first rate being faster than said second rate.

25. The improvement of claim 24 wherein said first rate of periodicity for repeated attempts at closed loop control will result despite repeated occurrences of said event that indicates non-operability, unless and until said measure of confidence diminishes below a predetermined limit.

26. In a fuel delivery system for use with an automobile having an internal combustion engine and an engine coolant system, the fuel delivery system including:

temperature sensing means for sensing temperature of engine coolant contained within said engine coolant system and for providing a coolant temperature signal in response thereto;

oxygen sensing means for sensing oxygen in a monitored area of said automobile and for providing an oxygen sense signal in response thereto;

fault detection means for responding to indicia that said oxygen sensing means has faulted, and for providing a fault signal in response thereto; and control means for receiving said oxygen sense signal, said fault signal, and said coolant temperature signal, and for selectively providing:

closed loop control of said fuel delivery control signal, based at least in part on said oxygen sense signal; and open loop control of said fuel delivery control signal upon receiving said fault signal, wherein said open loop control substantially ignores said oxygen sense signal;

an improvement comprising:

confidence measuring means for measuring confidence in said oxygen sensing means based on previous operability thereof and for providing a measure of confidence based thereon;

first delay means for causing said control means to delay switching from said closed loop control to said open loop control upon receiving said fault signal, said delay having a duration that depends, at least in part, upon said measure of confidence; and closed loop reinitiation means for periodically causing said control means, while providing open loop control of said output control signal, to attempt said closed loop control of said output control signal, and upon attempting said closed loop control and the in the absence of said fault signal, for subsequently causing said closed loop control to be maintained, wherein said periodicity of attempting said closed loop control depends, at least in part, upon said measure of confidence;

second delay means for causing said control means to provide only said open loop control upon initially starting said engine until both said coolant temperature has at least equalled a predetermined limit and a second engine operating parameter has at least equaled a predetermined value, and to thereafter allow said control means to attempt to provide said closed loop control.

* * * * *

UNITED STATES PATENT AND TRADEMARK OFFICE

CERTIFICATE OF CORRECTION

PATENT NO. : 4,671,243

DATED : June 9, 1987

INVENTOR(S) : Robert W. Deutsch

It is certified that error appears in the above-identified patent and that said Letters Patent is hereby corrected as shown below:

Column 9, line 38, please correct the spelling of the word "maixmum" to --maximum--.

Column 10, line 1, please correct the words "inthe" to --in the--.

Column 10, line 40, please correct the spelling of the words "whereins aid" to --wherein said--.

Column 10, line 44, correct the spelling of the words "mean sfor" to --means for--.

Column 10, line 57, please correct the spelling of the words "signal,a nd" to --signal, and--.

Signed and Sealed this

Third Day of November, 1987

*Attest:*

DONALD J. QUIGG

*Attesting Officer*

*Commissioner of Patents and Trademarks*